US005634398A

United States Patent [19]

McGee et al.

[11] Patent Number: 5,634,398

[45] Date of Patent: Jun. 3, 1997

[54] PANEL PRESS WITH MOVABLE PLATENS WHICH ARE INDIVIDUALLY CONTROLLED WITH POSITION-SENSOR TRANSDUCERS

[75] Inventors: Arthur L. McGee, Lake Oswego; David W. Rudman, Newberg, both of Oreg.

[73] Assignee: The Coe Manufacturing Co., Portland, Oreg.

[21] Appl. No.: 621,119

[22] Filed: Mar. 22, 1996

[51] Int. Cl.[6] ..... B30B 7/02

[52] U.S. Cl. ..... 100/43; 100/99; 100/199; 100/257; 100/322; 100/325; 156/583.1; 425/338

[58] Field of Search ..... 100/43, 93 P, 99, 100/194, 199, 257; 156/583.1; 425/338, 339

[56] References Cited

U.S. PATENT DOCUMENTS

| | | | |
|---|---|---|---|
| 3,041,666 | 7/1962 | Dorenbos et al. | 100/194 |
| 3,242,533 | 3/1966 | Wintriss | 100/43 |
| 3,638,559 | 2/1972 | Parker | 100/93 P |
| 3,898,555 | 8/1975 | Tellerman | 324/34 D |
| 4,222,724 | 9/1980 | van Hüllen | 425/141 |
| 4,298,861 | 11/1981 | Tellerman | 340/365 L |
| 4,429,627 | 2/1984 | Edsö | 100/43 |
| 4,499,821 | 2/1985 | Clouston | 100/51 |
| 4,721,902 | 1/1988 | Tellerman | 324/58.53 |
| 4,726,226 | 2/1988 | Tellerman | 73/292 |
| 4,952,873 | 8/1990 | Tellerman | 324/207.13 |

FOREIGN PATENT DOCUMENTS

| | | | |
|---|---|---|---|
| 614736 | 9/1994 | European Pat. Off. | 100/43 |
| 1182795 | 12/1964 | Germany | 100/199 |
| 1076301 | 2/1984 | U.S.S.R. | 100/43 |
| 1386454 | 4/1988 | U.S.S.R. | 100/99 |
| 1452676 | 1/1989 | U.S.S.R. | 100/43 |
| 1181281 | 2/1970 | United Kingdom . | |
| 2133905 | 8/1984 | United Kingdom | 100/43 |

*Primary Examiner*—Stephen F. Gerrity
*Attorney, Agent, or Firm*—Klarquist Sparkman Campbell Leigh & Whinston, LLP.

[57] ABSTRACT

A multiple opening panel press is described with a plurality of movable platens which are individually controlled to adjust the spacing between adjacent platens to a predetermined panel width. Position-sensor transducers are employed to produce control signals corresponding to the platen positions which operate control cylinders by associated valves to adjust the platen spacing. The transducers are preferably sonic waveguides which interact with permanent magnets fixed to the movable platens to generate platen position signals which are applied to an automatic control system which includes a computer that produces the control signals.

20 Claims, 6 Drawing Sheets

PANEL PRESS WITH MOVABLE PLATENS WHICH ARE INDIVIDUALLY CONTROLLED WITH POSITION-SENSOR TRANSDUCERS

BACKGROUND OF THE INVENTION

The subject matter of the present invention relates generally to panel presses with movable platens to produce pressed panels of wood particles or other material with a predetermined thickness by controlling the press openings, and in particular to such a press in which the movable platens are individually controlled by position-sensor transducers which produce position signals for such platens that are used to actuate control cylinders for adjustment of each platen. Preferably, the position-sensor transducers are in the form of sonic waveguides which are mounted on a fixed upper platen and positioned adjacent permanent magnets which are fixed to the movable platens. In one embodiment the sonic waveguide transducers indicate the position of the movable platens by sensing sonic waves produced within a waveguide tube of magneto-strictive material when a moving electromagnetic field produced by an input pulse current flow in a conductor interacts with the stationary fields of the magnets so that the position of each movable platen may be determined by measuring the time period between an input pulse applied to the transducer and an output pulse of the transducer corresponding to the sonic wave.

It has previously been proposed in U.S. Pat. No. 4,222,724 to Van Hullen, issued Sep. 16, 1980, to provide a platen press having movable platens for pressing panels such as chipboards by controlling the press openings using platen adjustment cylinders. Each of such cylinders is connected to a different movable platen and such cylinders are simultaneously actuated for simultaneously closing the movable platens. Groups of cylinders are provided with each group mounted on a common support assembly which is pivotally attached to the frame adjacent the fixed upper platen. This multiple platen press has the advantage that it eliminates the need for previously used spacer strips positioned between adjacent platens to limit the platen openings to a predetermined spacing for controlling the thickness of the panels produced thereby. However, while this multiple platen press is less complicated than previous presses since it eliminates the need for spacer strips, it is not as accurate in producing panels of a predetermined thickness. Thus, the Van Hullen patent admits that the chipboard panels produced by such multiple platen press have small deviations from the desired thickness of the panels. This problem is solved by the multiple platen press of the present invention which employs position-sensor transducers such as sonic waveguide transducers with permanent magnets fixedly attached to the movable platens to produce position signals which accurately represent the positions of the movable platens during the operation of the press.

Sonic waveguide transducers have previously been employed for measuring liquid levels and other non-analogous purposes as described in U.S. Pat. No. 4,952,873 to Tellerman, issued Aug. 28, 1990. The Tellerman patent describes the use of sonic waveguides and a movable magnet to measure the level of a liquid in a tank by providing the magnet on a float which moves with the liquid level. However, there is no suggestion in this patent of employing such a sonic waveguide transducer to sense the position of movable platens in a multiple platen press in the manner of the present invention. The Tellerman patent also refers to his earlier patents on sonic waveguide transducers, including U.S. Pat. No. 3,898,555 to Tellerman, issued Aug. 5, 1975, U.S. Pat. No. 4,298,861 to Tellerman, issued Nov. 3, 1981, U.S. Pat. No. 4,721,902 to Tellerman, issued Jan. 26, 1988, and U.S. Pat. No. 4,726,226 to Tellerman, issued Feb. 23, 1988. However, these patents all show other non-analogous uses for the transducer. For example, Tellerman U.S. Pat. No. 4,298,861 patent relates to the use of a sonic waveguide transducer for encoding magnetic keys on a keyboard. Thus, in none of these prior art patents is the sonic waveguide transducer employed to sense the position of movable platens in a press for producing panels of pressed wood or other material of a predetermined thickness in the manner of the present invention.

U.S. Pat. No. 4,499,821 to Clouston, issued Feb. 19, 1985, relates to a system for immobilizing a plywood press platen during the press cycle. This patent describes a press including a system for immobilizing the hydraulic ram cylinder and thrust platen of a plywood press moved by such ram cylinder during the panel pressing cycle to avoid excessive panel compression. This is achieved by a valve assembly, a timing means and feedback means for sensing thrust platen movement and mechanically actuating the valve assembly. The Clouston system is not employed to control the movable intermediate platens in a multiple platen press as does the present invention which instead employs platen position-sensing transducers, such as a sonic waveguide and associated magnets, for sensing the positions of the movable platens and actuating control cylinders to more accurately control the final spacing between the platens for determining the thicknesses of the panels.

SUMMARY OF THE INVENTION

One object of the present invention is to provide an improved multiple opening press for the production of compressed panels, including a plurality of movable press platens which are adjusted in position more accurately to provide a predetermined final spacing or press opening between such platens in a simple, accurate manner to produce press panels of a predetermined thickness.

Another object of the invention is to provide such a press employing position-sensor transducers for sensing the positions of each of the movable platens and for producing platen position signals corresponding thereto which accurately control the final spacing distance between the movable platens.

A further object of the invention is to provide such a press in which the position-sensor transducers include permanent magnets which are fixed to the movable platens to indicate the position of such movable platens to the position sensor transducer in a simple, accurate manner.

An additional object of the invention is to provide such an improved press in which the movable platens are adjusted by fluid control cylinders which are operated by position control valves in response to the control signals produced by transducers in a simple, accurate and relatively inexpensive apparatus.

Still another object of the invention is to provide such a press having an automatic control system which includes a digital computer for producing the control signals for the control valves to activate the fluid cylinders in response to the platen position signals produced by the transducers.

A still further object of the invention is to provide such an improved press in which the platen position-sensing transducers include sonic waveguides which are positioned adjacent permanent magnets fixed to the movable platens for indicating the position of such movable platens with high accuracy.

BRIEF DESCRIPTION OF THE DRAWINGS

These and other objects of the invention will be apparent from the following detailed description of a preferred embodiment of the invention and from the attached drawings of which.

DETAILED DESCRIPTION

Figure 1:
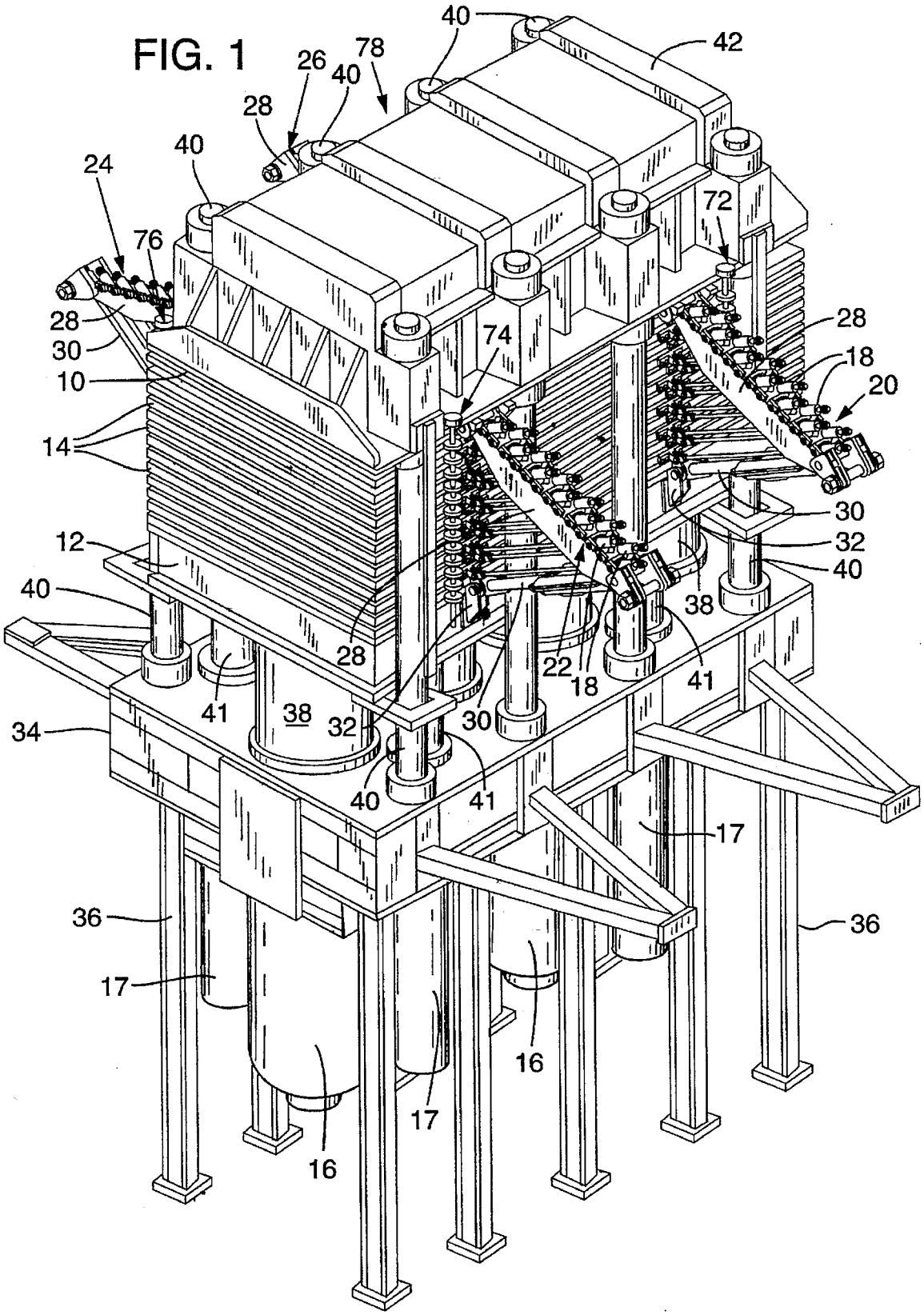
FIG. 1 is an oblique elevation view of a multiple opening press for the production of compressed panels employing an automatic control system for adjusting the movable platens in accordance with the preferred embodiment of the present invention.

As shown in FIG. 1, the multiple panel press of the present invention includes a fixed upper platen 10 and a movable lower thrust platen or platen table 12 which are separated by a plurality of intermediate movable platens 14. All of such platens may be heated platens of a conventional construction. The movable platen table or lower thrust platen 12 is moved upward by several main ram cylinders 16, and by a plurality of severaljack ram cylinders 17 which are positioned in a balanced and symmetrical manner, such as at four jack rams at the ram cylinders the four corners of the lower platen. The hydraulic power system powering the motion and control of the main ram cylinders and jack ram cylinders is conventional.

Each of the intermediate platens 14 is connected to a plurality of control cylinders 18 which are arranged in four groups of cylinders 20, 22, 24, 26, each group being mounted on a separate support assembly 28 which is pivotally connected at one end to the fixed upper platen 10. The other end of the support assembly 28 is pivotally connected to the upper end of a pivot arm 30 which is pivotally attached at its lower end to a bracket 32 fixed to the movable lower platen 12. Thus the intermediate platens 14 are moved upward with the lower platen 12 toward the fixed upper platen 10 by the main ram cylinders 16 and the jack ram cylinders 17 acting through the pivot arms 30 and associated assemblies 28. It should be noted that combinations of other than four control cylinder groups and support assemblies may be employed.

Each of the movable intermediate platens 14 is connected to four or more adjusting cylinders 18 each from a different one of the four or more groups of cylinders 20, 22, 24, 26 adjacent to the four corners of the platen. These four control cylinders maintain the platen level and in a precisely adjusted spacing relative to its adjacent platen in a manner hereinafter described. It should be noted that the positions of the cylinders may be other than at the four corners of the movable platens 14.

The press, including the main and jack ram cylinders 16 and 17, is mounted on a fixed frame 34 secured to a concrete pad by legs 36 in a conventional manner. Each of the main ram cylinders 16 includes a piston 38 which is secured to the bottom of the movable lower platen 12 to move it upward along a plurality of vertical guide rods or columns 40. In a like manner each of the jack ram cylinders 17 includes a piston 41 which is secured to the bottom of the movable lower platen 12 for aiding in the movement of such platen. The upper platen 10 is fixed in place to the frame by attachment to the top of the guide rods and to a press cap 42 in a conventional manner.

Figure 2:
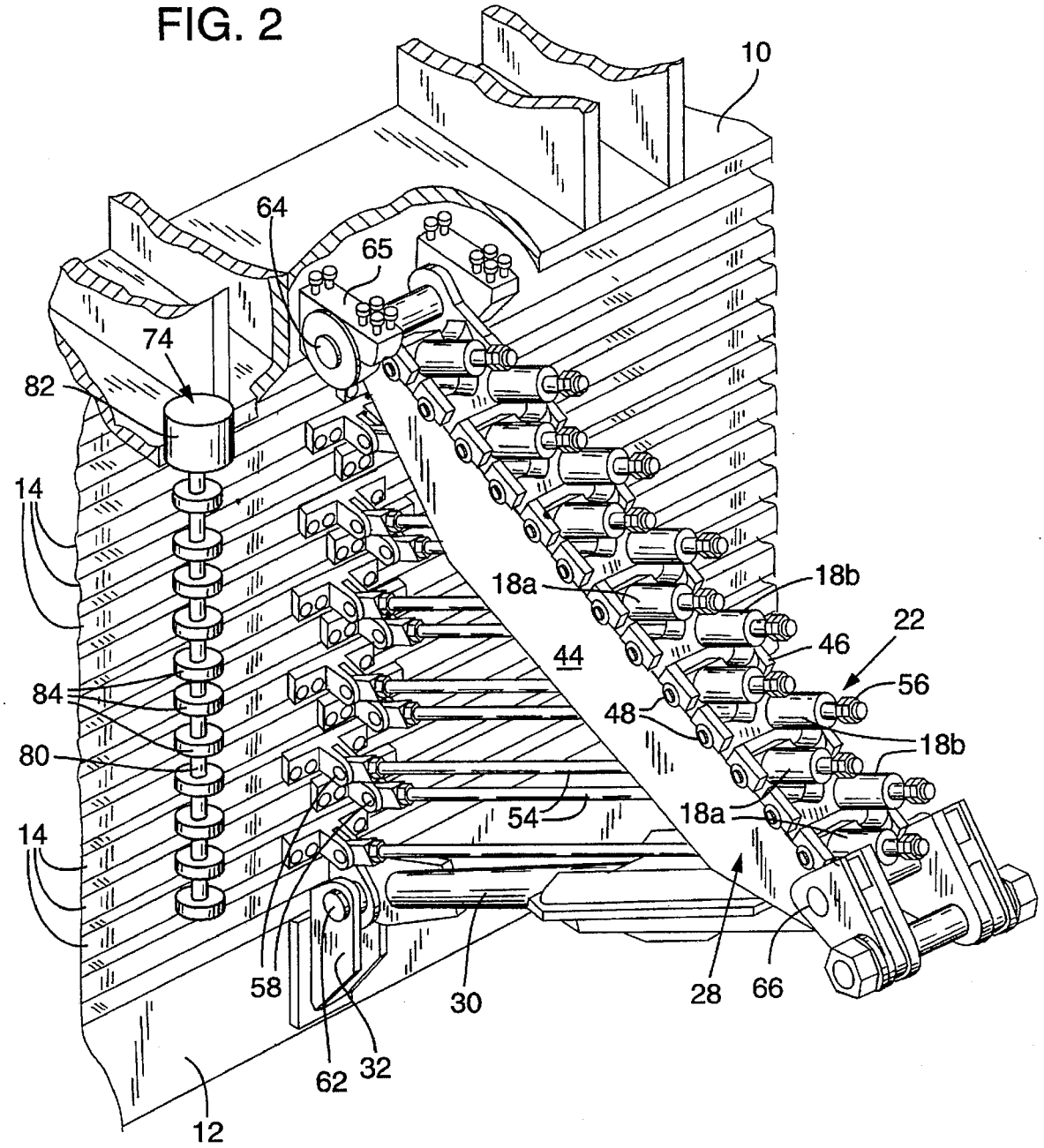
FIG. 2 is an enlarged view of a portion of the press of FIG. 1.
Figure 3:
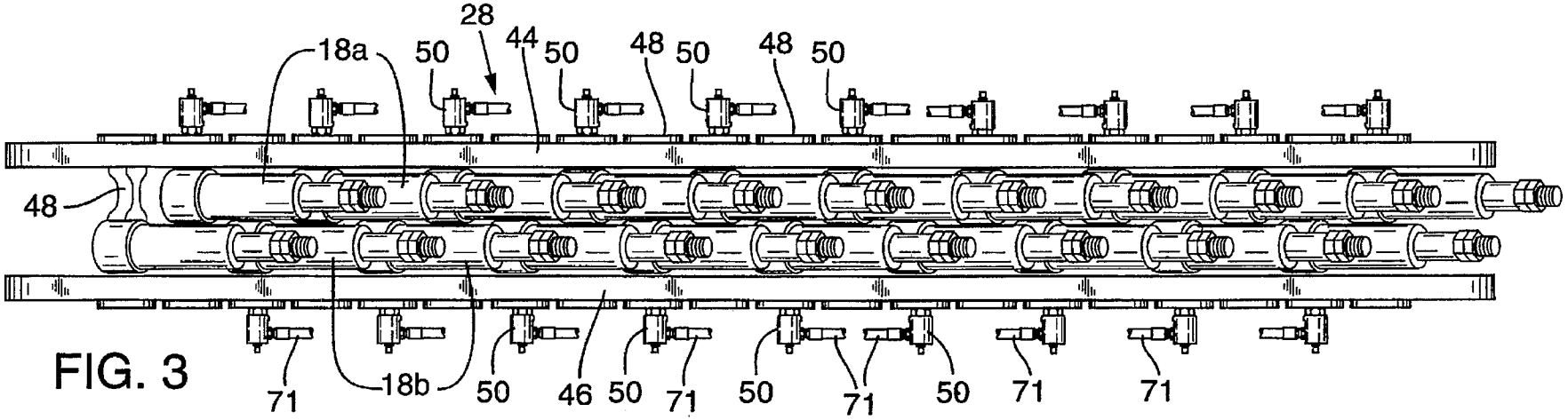
FIG. 3 is a top elevation view of the cylinder support assembly apparatus of FIG. 2.

As shown in FIG. 2, each of the support assemblies 28 supporting the cylinder groups 20, 22, 24 and 26 includes a pair of support arms 44, 46 which are spaced apart to allow two sets of control cylinders 18A and 18B to be pivotally mounted on trunion shafts 48 extending between such pair of support arms in accordance with FIGS. 2–5. The control cylinders are positioned in two rows 18A and 18B of staggered cylinders, each being mounted on a separate trunion shaft 48 extending between the support arms 44 and 46.

Figure 5:
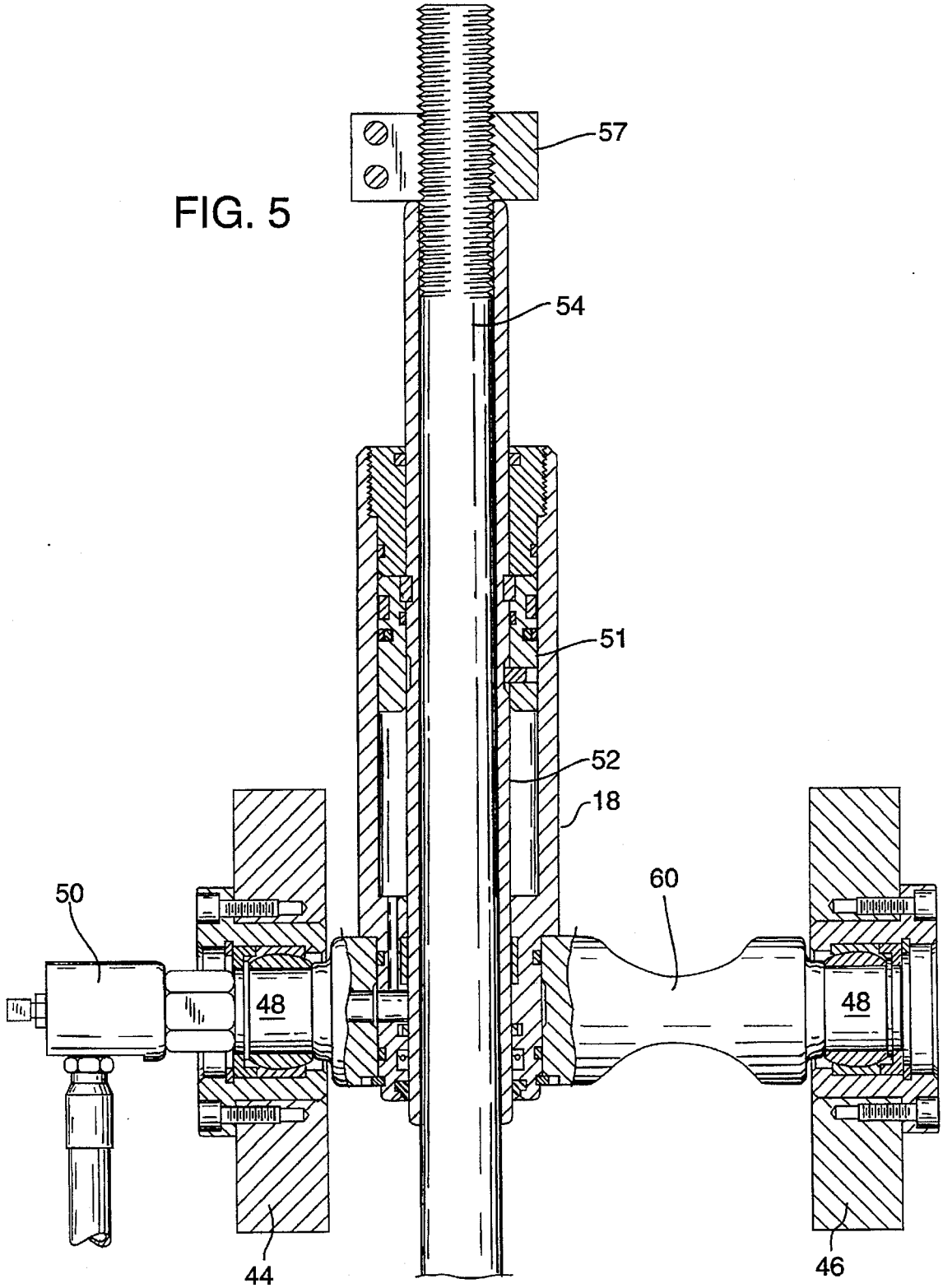
FIG. 5 is an enlarged section view of one of the control cylinders and its associated adjustment rod in the apparatus of FIGS. 3 and 4.

Hydraulic hose fittings 50 are connected to the cylinders 18 through the side support arms 44 and 46 in a manner hereinafter described. The hydraulic hose fittings 50 are each connected to one of the cylinders 18. Each of the control cylinders 18 includes a piston 51 that is fixed to a hollow piston rod sleeve 52 through which a connecting rod 54 extends as shown in FIG. 5. The upper end of the connecting rod 54 is threaded and secured to an adjustable split clamp nut 57. This clamp nut 57 and connecting rod 54 to which it is attached are held in contact with the piston rod 52 in the downward direction by gravity due to the weight of the platen 14. The lower end of each connecting rod 54 is pivotally connected by a bracket 58 to one of the movable intermediate platens 14 as shown in FIG. 2. Each of the trunions 48 is provided with a saddle-shaped trunion member 60 for accommodating one of the control cylinders 18 on the adjacent trunion, as shown in FIG. 5. Thus, two of the cylinders 18A and 18B are arranged in staggered size-by-side relationship and pivoted on two separate adjacent trunion shafts between the support arms 44 and 46.

As the movable lower platen 12 is moved upward by the main and jack ram cylinders 16 and 17 during pressing of the panels, the pivot arm 30 pivots about a pivot connection 62 on bracket 32 and raises its associated common support assembly 28 upward. This raises all of the control cylinders 18 in such assembly group and their associated connecting rods 54 which in turn raises the movable intermediate platens 14 with the bottom platen 12 upward toward the fixed upper platen 10 thereby reducing the spacing between adjacent platens. After the press is closed by the ram cylinders and the platens are heated to soften the panel mat material, the movable platens are adjusted by the control cylinders 18 to their final spacing to produce pressed panels of a predetermined thickness, as hereinafter described. The common support assembly 28 including support arms 44, 46 pivots during the press operation about a pivot connection 64 on a bracket 65 attached to the fixed upper platen 10 as shown in FIG. 2. Also, the common support assembly 28 is connected to the pivot arm 30 by another pivot connection 66 at the outer end thereof to allow pivotal movement of such assembly upward as the movable lower platen 12 is raised by the ram cylinders.

Figure 4:
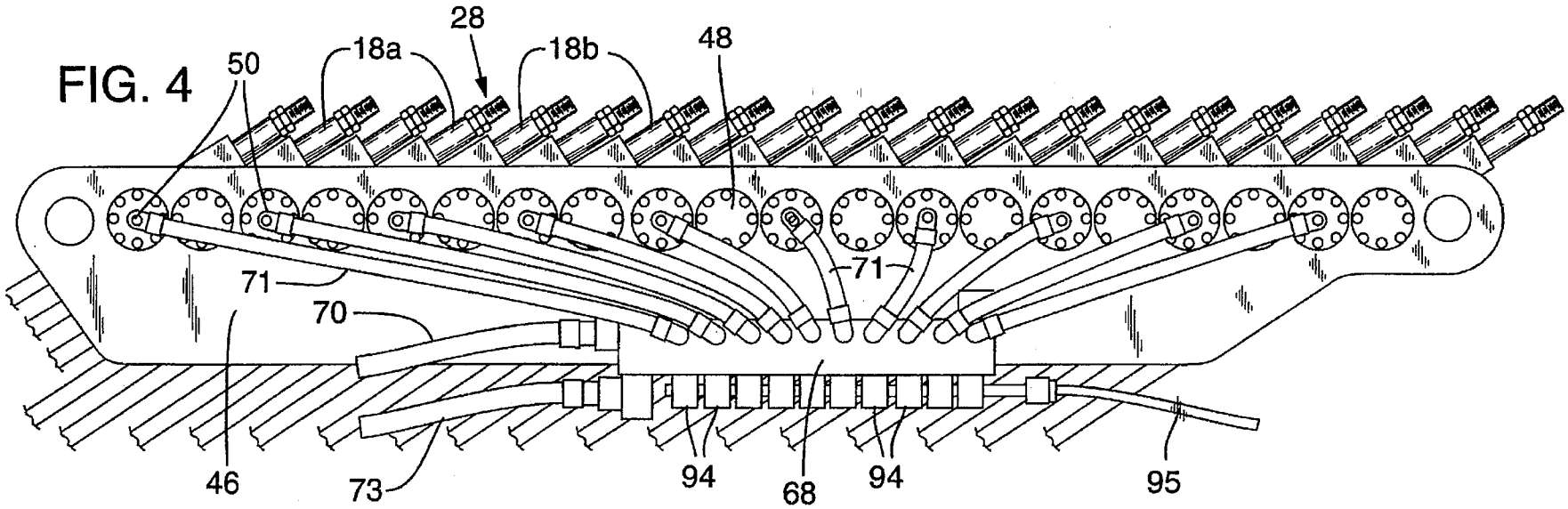
FIG. 4 is a side elevation view of the apparatus of FIG. 3.

As shown in FIG. 4, each of the hydraulic control cylinders 18 is connected by one of a plurality of input hoses 71 through the hydraulic hose fittings 50 to a common manifold 68. The manifold is connected by a supply hose 70 to a hydraulic fluid source 96 of high pressure as shown in FIG.

7. A plurality of position control servo valves 94 are each connected internally with the manifold 68 between the fluid source 96 and one of the input hoses 71 coupled to control cylinders 18 to control such cylinders by the automatic control system of FIG. 7. As a result, all of the control cylinders 18 are individually and simultaneously actuated by the control system through valves 94. Fluid flowing from the cylinders and valves as a result of their operation is returned to the hydraulic fluid source by a return hose 73 connected the manifold 68. It should be noted that during the pressing cycle the gross upward motion of the press is caused by the upward movement of the lower thrust platen 12 under the action to the main and jack ram cylinders 16 and 17. The gross motion of each of the platens 14 is caused by the upward motion of the lower thrust platen 12 through the linkage comprised of pivot arm 30, support assembly 28, cylinders 18 and connecting rods 54 so that the distance between each of the platens 14 is reduced at the same rate until said distance approaches the desired final value.

Figure 7:
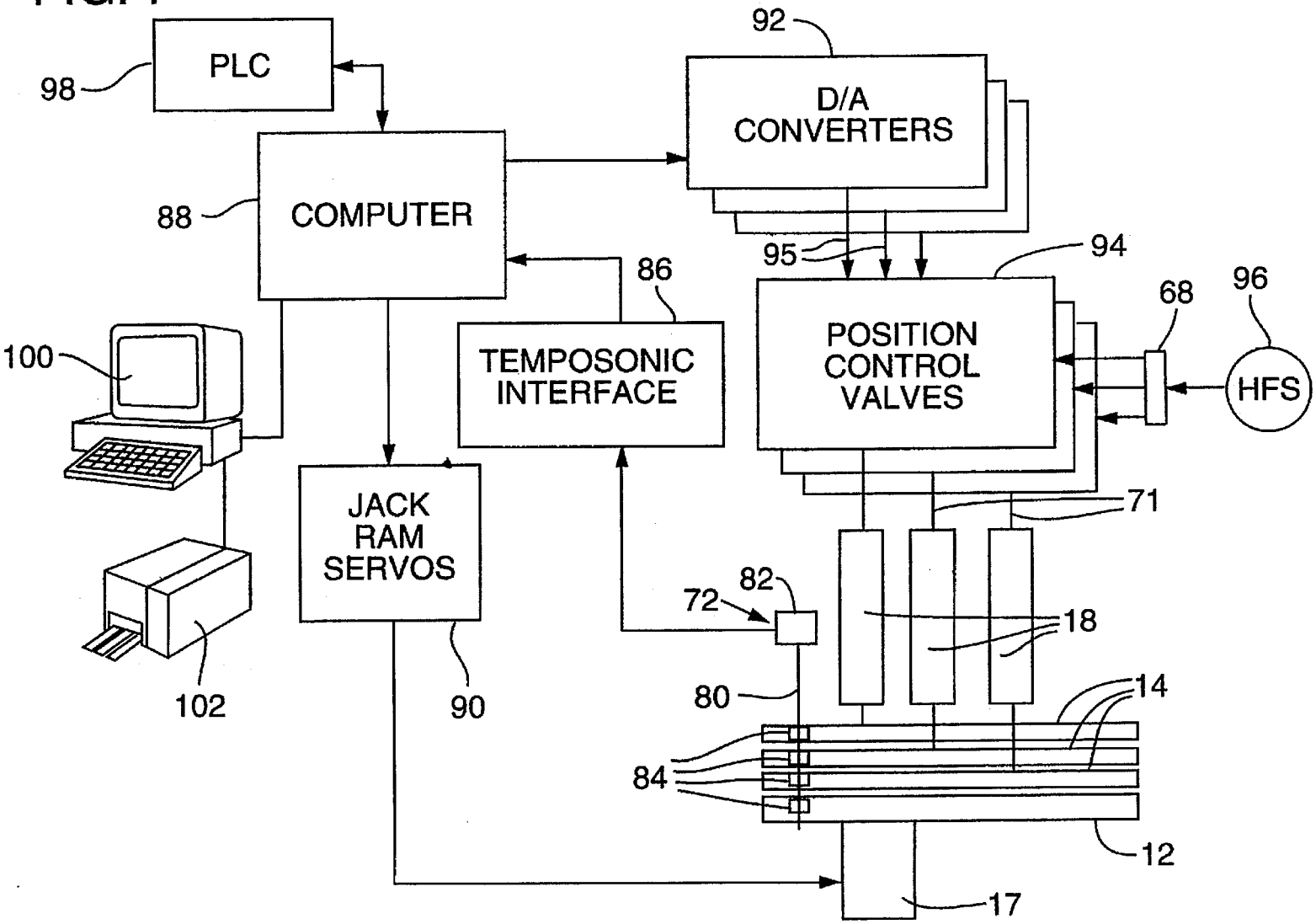
FIG. 7 is a schematic block diagram of an automatic control system for adjusting the position of the movable platens in the press of FIGS. 1–6.

During the pressing cycle the control cylinders 18 are operated by the electrically actuated servo valves 94 in response to control signals applied thereto by electrical conductors 95 to vary the fluid pressure within such cylinders in response to the operation of the control system of FIG. 7. This causes the sleeve pistons 52 within cylinders 18 to move in response to such signals. The motions of the sleeve pistons 52 acting through connecting rods 54 vary by a relatively small but significant amount the relative position of platens 14 while their gross position is being reduced by the upward motion of the lower thrust platen 12 as described above.

At the end of the press cycle the press returns to the open position under the influence of the weight of the lower thrust platen 12 and platens 14 acting through the linkage comprised of support assembly 28, pivot arm 30 and other elements as described above. As the press opens in this manner the servo valves 94 increase the hydraulic fluid pressure in cylinders 18 in response to electrical signals from the control system of FIG. 7. Pistons 52 are returned to the upper limit of their stroke holding the connecting rods 54 and the platen 14 attached thereto in a fixed relative position until the start of the next pressing cycle.

Figure 6:
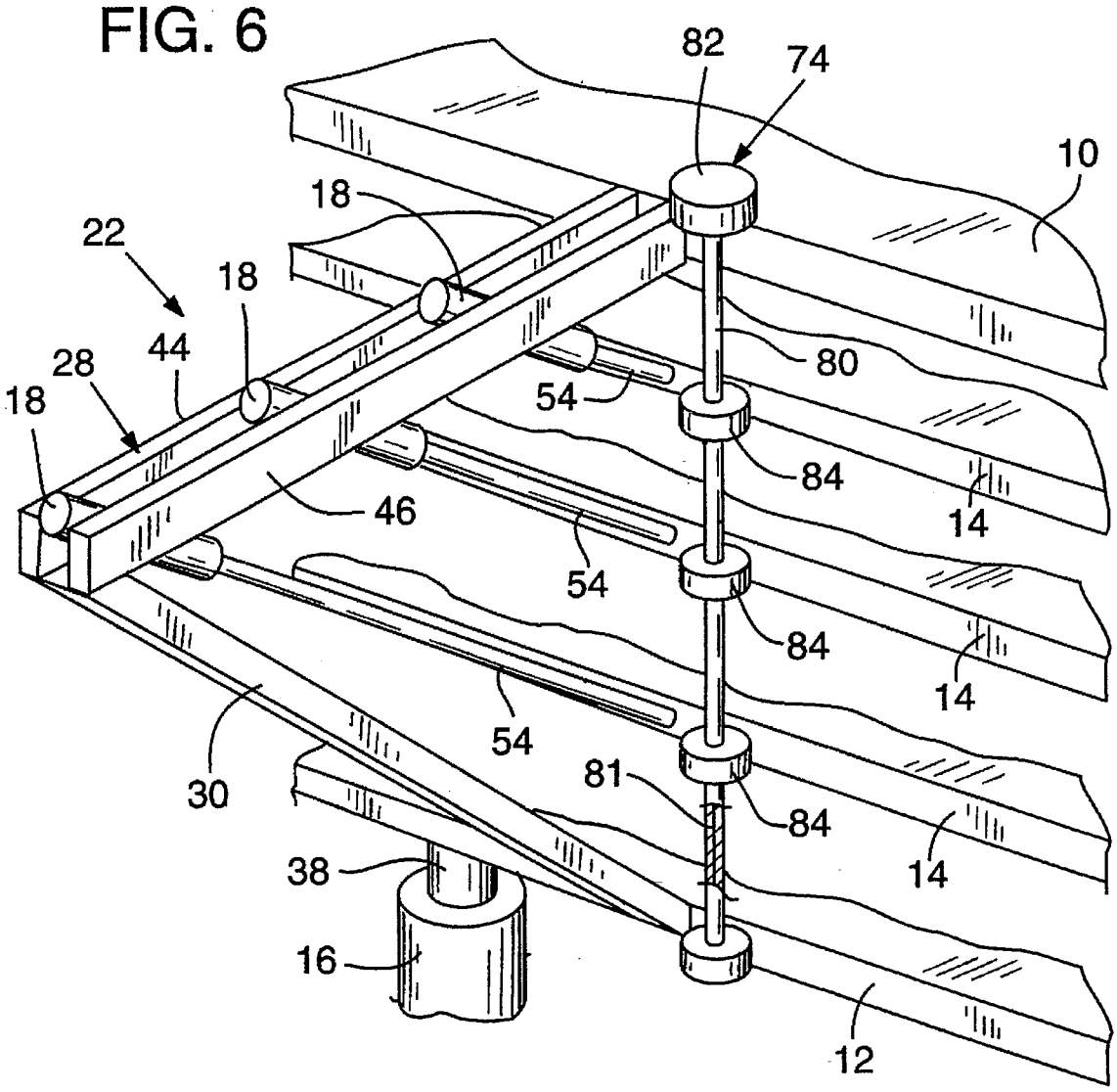
FIG. 6 is a simplified diagram of the platen position-sensor and control cylinder apparatus of FIG. 2 showing its operation.

Four position-sensing transducers 72, 74, 76, 78 are provided adjacent the four corners of the platens with a different transducer adjacent each of the four groups 20, 22, 24 and 26 of control cylinders. As shown in FIG. 6, each of the position-sensor transducers, such as transducer 74, preferably includes a sonic waveguide tube 80 containing a conductor wire 81 mounted coaxial with said tube, such tube and wire being fixed at their upper ends by a transducer housing 82 to the fixed upper platen 10. A plurality of permanent magnets 84 are fixedly mounted, such as by clamping, on the movable intermediate platens 14 and on the movable lower platen 12 in order to move with such platens. The magnets 84 may be in the form of annular flat rings which surround the waveguide tube 80 or a protective tubing within which the waveguide tube is mounted. The housing 82 contains the transducer electronic circuitry including a pulse generator for applying an electrical input pulse to the upper end of connector wire 81 and a converter for producing output pulses corresponding to the receipt of sonic wave reflections from magnets 84, as shown and described in U.S. Pat. No. 4,952,873 to Tellerman which is hereby incorporated by reference. In the preferred embodiment, the position-sensor transducer is a Temposonic sonic waveguide transducer manufactured by MTS Systems Corporation, the assignee of Tellerman U.S. Pat. No. 4,952,873, and is similar to that shown in FIGS. 2 and 4 of such patent. However, the transducers may be any of the waveguide embodiments shown in this patent.

The sonic waveguide position-sensor transducers 72, 74, 76 and 78 each operate in the manner described in the above-cited Tellerman patent, U.S. Pat. No. 4,952,873. Briefly, when an electrical input pulse is transmitted through the central wire conductor 81, it produces a moving electromagnetic field around such conductor due to the current flow. The sonic waveguide tube 80 is made of magnetostrictive material which produces a sonic wave within such waveguide as a result of the electromagnetic field. When the moving electromagnetic field reaches the permanent magnets 84 their stationary magnetic fields interact with the moving field and causes the waveguide tube to produce a torsion strain sonic pulse for each magnet. A portion of this sonic pulse is transmitted back to a mode-converter detector within the electronic circuitry mounted in the transducer housing 82 where the sonic wave is converted to a electrical output pulse. As a result the position of the movable platens 14 and 12 relative to the fixed upper platen 10 may be determined with high accuracy from the time period between the input pulse produced by the pulse generator and the output pulse produced by the sonic wave as hereinafter described.

As show in FIG. 7, an automatic control system for controlling the positions of the movable platens 12, 14 in accordance with the present invention includes the four position-sensor transducers 72, 74, 76 and 78, only one of which is shown. As discussed above, each of the transducers produce an input pulse and an output pulse which are detected to determine the time period between such pulses. This time period signal is transmitted from a transducer output circuit 82 to a Temposonic interface circuit 86 which produces a platen position signal for each movable platen, that is applied as an input signal to a general-purpose digital computer 88. The computer is programmed and operated by a programmable logic controller 98 to produce a control signal corresponding to the position signal, which is applied to position control servo valves 94 to operate the control cylinders 18 and control the position of the platens 12 and 14. The position signal corresponds to the time period between the input pulse and the output pulse for each magnet 84 which determines the position of each of the intermediate movable platens 14 and the movable lower platen 12 with respect to the fixed upper platen 10 on which the transducer housing 82 is mounted.

The press is configured so that the moving bottom platen 12 moves up and towards the fixed upper platen 10 in such a manner that the movable platen remains parallel to the fixed upper platen. Process variations between panel mats such as mat position, basis weight, moisture content, layer composition and other considerations normal to panel board manufacturing can cause the moving platen to become non-parallel with the fixed platen during the press cycle. Other factors such as bearing wear and damage can also affect the closing system geometry.

The platen position-sensor system monitors the relative position of the moving platen in relationship to the fixed platen during the entire press cycle. As shown in FIG. 7, the position signals are transmitted from the transducers 82 to the Temposonic interface 86 and in turn to a computer 88. Control action for maintaining parallelism of the moving platen is produced by the computer 88 and the programmable logic controller 98 for adjustment of the four jack ram servo valves 90.

As previously described, small differences in panel mat composition, machine wear, and linkage adjustment that can exist between openings, the distance between platens during the pressing cycle may not be simultaneously maintained. In order to reduce this variation in spacing between adjacent platens the control action applied to the cylinder 18 equalizes the relative positions of the intermediate platens to achieve a final spacing between adjacent platens. This final spacing corresponds to the predetermined thickness of the panels to be produced by the press.

The computer 88 and the programmable logic controller 98 also produce a ram control output signal which is transmitted to four jack ram servo valves 90 which each control one of the jack ram cylinders 17. The platen position signal produced by the transducer interface 86 causes the computer 88 to produce digital control signals for each of the control cylinders 18 which are converted into analog control signals by digital-to-analog converters 92. Each analog control signal is applied through conductors 95 to one of the position control servo valves 94 for controlling pressure flow to their associated control cylinders 18. The position control servo valves 94 can be pressure reducing valves or pressure control valves.

The position control servo valves 94 are connected to a pressurized hydraulic fluid source 96 which may be a pump operated by an electric motor to supply fluid pressure to the common manifold 68. The servo valves 94 selectively connect the control cylinders 18 to the manifold 68 through the servo valves when they are opened. The servo valves are actuated by the position control signals produced by computer 88 in response to the platen position signals produced by transducers and correspond to the positions of the magnets 84 fixed to the movable platens. In this manner, the control cylinders 18 are automatically controlled to accurately position the movable platens so that the spacing between adjacent platens is adjusted to a predetermined panel thickness.

It should be noted that the computer 88 is programmed by the programmable logic controller 98 to store a suitable computer program in its memory. This computer program may also be modified with input data, such as desired panel thickness, by a conventional computer user terminal 100. In addition, the user terminal 100 can be connected to a printer 102 for printing out input and/or output data of the computer.

It will be obvious to those having ordinary skill in the art that many changes may be made in the above-described preferred embodiment of the present invention. Therefore, the scope of the present invention should only be determined by the following claims.

We claim:

1. A multiple opening press for the production of compressed panels, comprising:

a plurality of press platens including a fixed platen and several movable position adjustable platens which are spaced apart by nominal panel openings;

a press operating mechanism for pressing the movable platens together to compress panel material between said platens and form compressed panels of predetermined thicknesses;

a plurality of adjustment devices connected to the movable platens for adjusting the spacings between said platens to control the thicknesses of the panels;

actuator devices for actuating said adjustment devices in response to electrical control signals;

sensor devices for sensing the positions of the movable platens relative to the fixed platen and to each other, said sensor devices including transducers for producing platen position signals corresponding thereto; and an automatic control system for operating said actuator devices by producing said control signals in response to corresponding platen position signals.

2. A press in accordance with claim 1 in which the sensor devices include a plurality of magnets which are each fixed to a different movable platen for movement therewith and are positioned adjacent to a position sensor transducer which is mounted on said fixed platen.

3. A press in accordance with claim 2 in which the transducer is a sonic waveguide which includes an electrical conductor wire supported within a magneto-strictive tube, the magnets are rings which surround said tube but are fixed to different ones of the movable platens, and an electrical pulse generator is connected at its output to said conductor wire.

4. A press in accordance with claim 1 in which the adjustment devices are fluid cylinders and the actuator devices are fluid control valves for controlling fluid pressure in said cylinders in response to said control signals.

5. A press in accordance with claim 4 in which the press operating mechanism includes at least four fluid actuated rams which press a bottom movable platen upward toward a top fixed platen, and each movable platen is connected at spaced connections to a plurality of adjustment cylinders for adjustment of the movable platen.

6. A press in accordance with claim 4 in which the adjustment cylinders are connected by connecting rods to the movable platens, each connecting rod being coupled by an adjustment nut to the piston rod of said cylinder.

7. A press in accordance with claim 4 in which a group of adjustment cylinders connected to the movable platens are mounted on a common adjustment assembly which is attached to the fixed platen.

8. A press in accordance with claim 7 in which the adjustment assembly is pivotally attached at one end to a top fixed platen and is pivotally attached at its other end to a bottom movable platen by a connecting arm.

9. A press in accordance with claim 1 in which the control system includes a digital computer for producing said control signals in response to said platen position signals.

10. A multiple opening press for the production of compressed wood panels, comprising:

a plurality of heated press platens including a fixed platen and several movable position adjustable platens which are spaced apart by nominal openings;

a press operating mechanism including a moving press table for pressing the movable platens together and toward the fixed platen to heat and compress sheets of wood material and bonding material between said platens and form compressed wood panels of a predetermined thickness;

at least one adjustable hydraulic cylinder on each corner of the moving press table;

a plurality of adjustment assemblies each including a plurality of adjustment cylinders connected to the movable platens for adjusting the spacings between said platens to control the thicknesses of the panels;

actuator valves for actuating said adjustment cylinders in response to control signals;

position sensor devices for sensing the positions of the movable platens and including transducers for producing platen position signals corresponding thereto; and an automatic control system for operating said actuator valves by producing said control signals in response to corresponding platen position signals.

11. A press in accordance with claim 10 in which the sensor devices include a plurality of magnets which are each fixed to a different movable platen for movement therewith and are positioned adjacent to a magnetic transducer which is mounted on said fixed platen and serves as a reference position indicator.

12. A press in accordance with claim 11 in which the transducer is a sonic waveguide which includes an electrical conductor wire supported within a magneto-strictive tube and the magnets are rings which surround said tube but are fixed to different ones of the movable platens, and an electrical pulse generator connected at its output to said conductor wire.

13. A press in accordance with claim 10 in which the actuator valves are servo valves for controlling fluid pressure in said cylinders in response to said control signals.

14. A press in accordance with claim 10 in which the control system includes a digital computer for producing said control signals in response to said platen position signals.

15. A press in accordance with claim 10 in which the press operating mechanism includes at least four fluid actuated rams which press a bottom movable platen toward a top fixed platen in a controlled manner, and each movable platen is connected at spaced connections to a plurality of adjustment cylinders for adjustment of the platen position.

16. A press in accordance with claim 10 in which the adjustment cylinders are connected by connecting rods to the movable platens, each connecting rod being coupled by an adjustment nut to the piston rod of said cylinder.

17. A press in accordance with claim 10 in which a group of adjustment cylinders connected to the movable platens are mounted on a common adjustment assembly which is attached to the fixed platen.

18. A press in accordance with claim 17 in which the adjustment assembly is pivotally attached at one end to a top fixed platen and is pivotally attached at its other end to a bottom movable platen by a connecting arm.

19. A multiple opening press for the production of compressed panels, comprising:

a plurality of press platens including a fixed platen and several movable platens which are spaced apart by panel openings of variable spacings;

a press operating mechanism including a movable platen table for pressing the movable platens together to compress panel material between said platens and form compressed panels of predetermined thicknesses;

at least four hydraulic cylinders connected to the movable platen table for moving said table and keeping it parallel to the fixed platen;

a plurality of adjustment cylinders connected to the movable platens for adjusting the final spacings between said platens to control the thicknesses of the panels;

actuator devices for actuating said adjustment cylinders in response to electrical control signals;

position sensor devices for sensing the positions of the movable platens including magnets attached to said movable platens for movement therewith, and including a transducer for producing platen position signals corresponding to the movable platens; and an automatic control system for operating said actuator devices by producing said control signals in response to corresponding platen position signals.

20. A press in accordance with claim 19 in which the transducer is a sonic waveguide which includes an electrical conductor wire supported within a magneto-strictive tube and the magnets are rings which surround said tube, said transducer being mounted on the fixed platen, and an electrical pulse generator connected at its output to said conductor wire.

* * * * *